US008117860B2

(12) United States Patent
Stone et al.

(10) Patent No.: US 8,117,860 B2
(45) Date of Patent: Feb. 21, 2012

(54) REFRIGERATION UNIT WITH INTEGRATED STRUCTURAL CONDENSER COIL SUPPORT

(75) Inventors: Dennis M. Stone, Cicero, NY (US); Thomas A. Anderson, Cato, NY (US); Jason Scarcella, Cicero, NY (US)

(73) Assignee: Carrier Corporation, Farmington, CT (US)

( * ) Notice: Subject to any disclaimer, the term of this patent is extended or adjusted under 35 U.S.C. 154(b) by 210 days.

(21) Appl. No.: 12/445,430

(22) PCT Filed: Dec. 22, 2006

(86) PCT No.: PCT/US2006/048841

§ 371 (c)(1),
(2), (4) Date: Apr. 13, 2009

(87) PCT Pub. No.: WO2008/045113

PCT Pub. Date: Apr. 17, 2008

(65) Prior Publication Data

US 2010/0083681 A1 Apr. 8, 2010

(51) Int. Cl.
*F25D 23/12* (2006.01)

(52) U.S. Cl. ..... 62/259.1; 62/263

(58) Field of Classification Search ..... 62/259.1, 62/262, 263, 239, DIG. 16, 506; 165/184, 165/178; 312/236, 242, 245, 247
See application file for complete search history.

(56) References Cited

U.S. PATENT DOCUMENTS

| | | | | | |
|---|---|---|---|---|---|
| 3,246,592 | A * | 4/1966 | Rath | 454/91 |
| 3,733,849 | A | 5/1973 | Cantagallo et al. | |
| 4,189,123 | A | 2/1980 | Johnson | |
| 5,187,945 | A * | 2/1993 | Dixon | 62/234 |
| 5,337,579 | A * | 8/1994 | Saia, III et al. | 62/239 |
| 5,406,823 | A * | 4/1995 | Yong et al. | 72/334 |
| 5,460,013 | A * | 10/1995 | Thomsen | 62/239 |
| 5,660,057 | A * | 8/1997 | Tyree, Jr. | 62/384 |
| 5,791,150 | A * | 8/1998 | Bosher et al. | 62/62 |
| 5,830,057 | A * | 11/1998 | Hunt, Jr. | 454/118 |
| 5,987,910 | A * | 11/1999 | Kothe et al. | 62/371 |
| 6,012,384 | A * | 1/2000 | Badalament et al. | 99/475 |
| 6,182,458 | B1 * | 2/2001 | Franklin, Jr. | 62/239 |
| 6,615,908 | B1 * | 9/2003 | Bosher et al. | 165/48.1 |
| 6,923,111 | B2 * | 8/2005 | Kiefer et al. | 99/468 |
| 7,406,834 | B2 * | 8/2008 | Williams | 62/115 |
| 2003/0150228 | A1 * | 8/2003 | Sanders | 62/243 |
| 2005/0241327 | A1 | 11/2005 | Daddis, Jr. et al. | |
| 2006/0277938 | A1 * | 12/2006 | Meyer et al. | 62/371 |

* cited by examiner

*Primary Examiner* — Mohammad Ali
(74) *Attorney, Agent, or Firm* — Cantor Colburn LLP

(57) ABSTRACT

A refrigeration unit for a shipping container exposed to end loads and rack loads. The refrigeration unit has a frame, a back panel, a plurality of structural support brackets secured to the back panel, a condenser cover secured to the plurality of structural support brackets so that the condenser cover, the plurality of structural support brackets, the frame, and the back panel form a structural member sufficient to support end loads and rack loads. The refrigeration unit also has a condenser coil having a first end and a second end, a first coil support member secured to one of the structural support brackets and secured around the first end, and a second coil support member secured to one of the structural support brackets and secured around the second end. The first and second coil support members maintain the condenser coil unstressed from the end loads and rack loads.

8 Claims, 2 Drawing Sheets

REFRIGERATION UNIT WITH INTEGRATED STRUCTURAL CONDENSER COIL SUPPORT

BACKGROUND OF THE INVENTION

1. Field of the Invention

The present disclosure is related to refrigeration units. More particularly, the present disclosure is related to refrigeration units for use with shipping containers.

2. Description of Related Art

Shipping containers are used for many purposes including storage and transportation of various types of goods. The shipping containers can be transported from one location to another, e.g. from a manufacture site to a desired location, via a variety of modes of transportation. For example, containers can be loaded on a truck or train. Or, in situations where goods need to be transported across bodies of water, for example international trade, the containers can be loaded onto ships. On the ships, the containers are usually stacked upon each other. Therefore, it is essential that containers be sturdy enough to withstand both rack loads and end loads to prevent the containers from crushing and damaging the goods. Rack loads are forces that are exerted on a container when containers are stacked upon one another. End loads are the forces exerted on a container due to the shifting of cargo.

Many of the goods that are stored and transported in containers require refrigeration systems. As such, it is common for refrigeration units to be attached to containers in order to preserve the goods. In most cases, containers and the associated refrigeration units are designed so that the refrigeration unit plays an essential role in the structure of the container. Typically, the condenser coils are made of very durable materials, such as copper and copper tube sheets, and are very strong. It is the condenser coil specifically that when attached to the frame plays an integral role giving structure and support to the container.

Accordingly, it has been determined by the present disclosure that there exists a need for a refrigeration unit that is designed so that the condenser coil is not a factor in the strength of the container so that smaller, lightweight coils can be used.

BRIEF SUMMARY OF THE INVENTION

It is an object of the present invention to provide a refrigeration unit for shipping containers.

These and other objects and advantages of the present invention are provided by a refrigeration unit for a shipping container exposed to end loads and rack loads. The refrigeration unit has a frame for securement to the shipping container, a back panel secured to the frame, a plurality of structural support brackets secured to the back panel, a condenser cover secured to the plurality of structural support brackets so that the condenser cover, the plurality of structural support brackets, the frame, and the back panel form a structural member sufficient to support the end loads and rack loads, a condenser coil having a first end and a second end, a first coil support member secured to one of the plurality of structural support brackets and secured around the first end, a second coil support member secured to one of the plurality of structural support brackets and secured around the second end. The first and second coil support members maintain the condenser coil unstressed from the end loads and rack loads.

A refrigeration unit for a shipping container suitable for withstanding end loads and rack loads is also provided. The refrigeration unit has a frame, a back panel attached to the frame, at least six support brackets, each one of the six support brackets being attached to the back panel, a condenser cover attached to the frame and to each one of the at least six support brackets, and a condenser coil attached to at least two of the at least six support brackets in a mariner such that the condenser coil is an unstressed member. The frame, the back panel, the at least six support brackets, and the condenser coil form a structure sufficient to withstand end loads and rack loads.

The above-described and other features and advantages of the present disclosure will be appreciated and understood by those skilled in the art from the following detailed description, drawings, and appended claims.

DETAILED DESCRIPTION OF THE INVENTION

Figure 1:
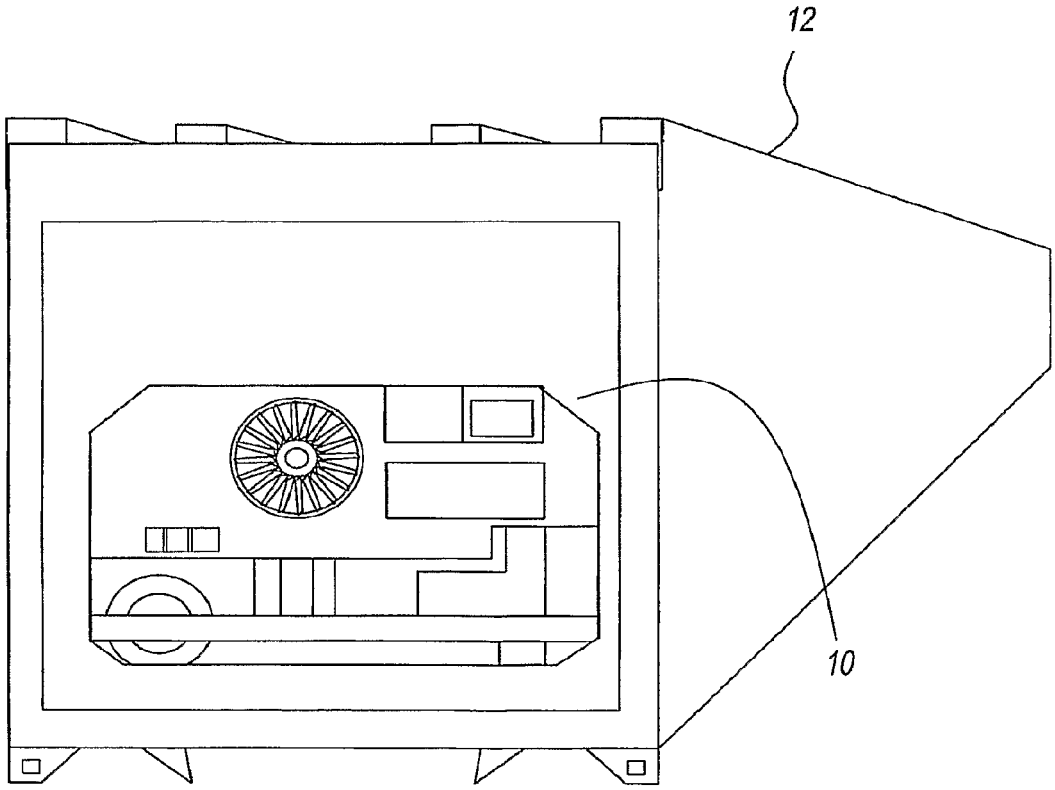
FIG. 1 is a side perspective view of a container with a refrigeration unit according to the present disclosure.

Referring to the drawings and in particular to FIG. 1, an exemplary embodiment of a refrigeration unit 10 is shown in relation to a container 12. Advantageously, refrigeration unit 10 is designed to give structural support to container 12 without stressing the condenser coil. With advances in technology, smaller, light-weight condenser coils have been designed which can be used in the refrigeration unit. The present disclosure contemplates the use of these lighter, smaller condenser coils in lieu of the larger, heavier coils due in part to reductions in associated manufacturing costs. However, due to the current design of the refrigeration units and containers, the replacement of a large condenser coil with the new smaller, lightweight coil would compromise the strength of the container's structure. Consequently, the container would not have sufficient strength to withstand the rack and end loads to which it would be susceptible. The present disclosure provides a solution.

Figure 2:
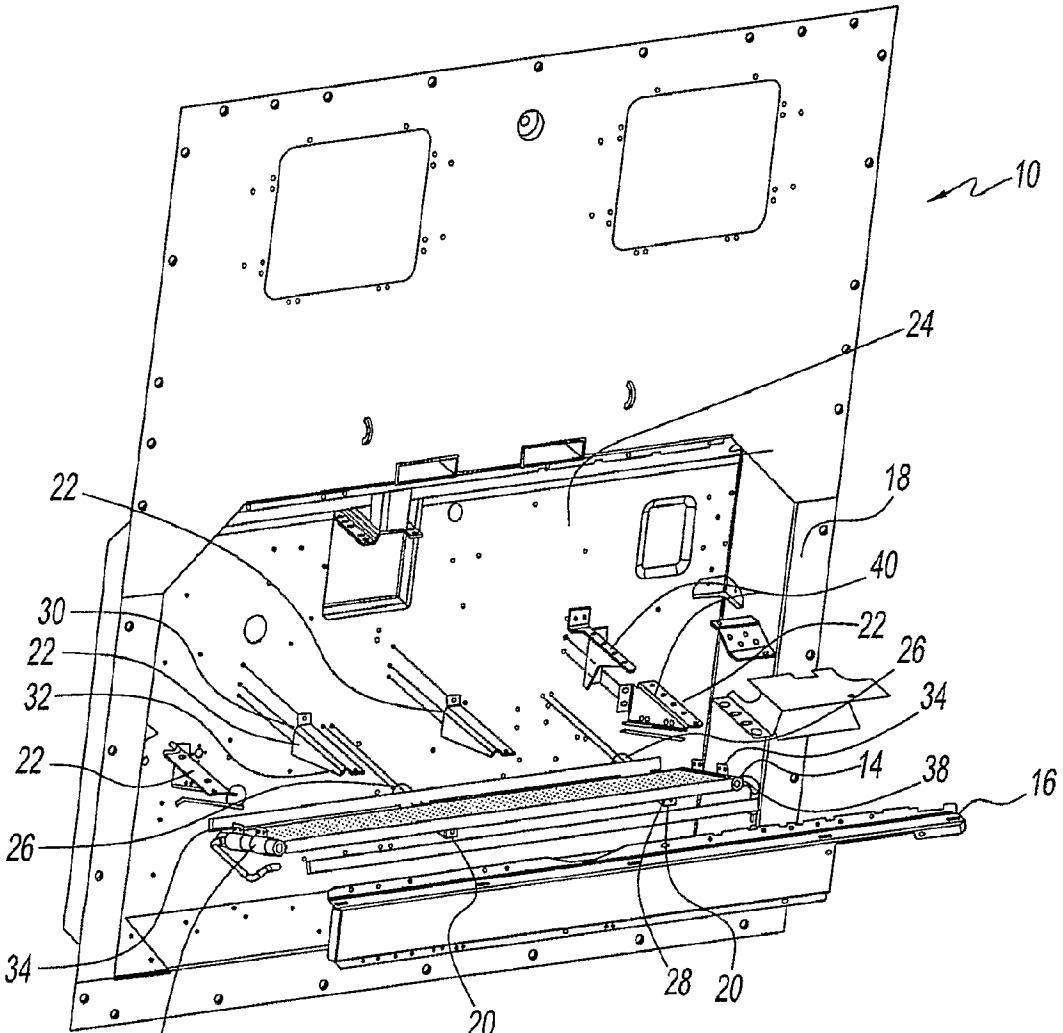
FIG. 2 is a partially exploded view of a refrigeration unit according to the present disclosure.

Referring now to FIG. 2, an exemplary embodiment of refrigeration unit 10 according to the present disclosure is shown. Refrigeration unit 10 includes a condenser coil 14, a condenser cover 16, a frame 18, a plurality of structural supports 40, and a back panel 24.

Condenser coil 14 is of any known type suitable for use in refrigeration unit 10. In one embodiment, condenser coil 14 is a micro channel heat exchanger coil. Condenser coil 14 has a first end 36 and a second end 38. Additionally, condenser coil 14 has one or more coil support members 34. At least one coil support member 34 is on first end 36. And, at least one coil support member 34 is on second end 38. Condenser coil 14 is an unstressed member. For purposes herein, an "unstressed member" is a structure that does not play a role in providing structure to container 12.

Condenser cover 16 is any known type suitable for use in refrigeration unit 10. It is foreseen that condenser cover 16 can be any type of metal, plastic, or plastic composite. In one embodiment, condenser cover 16 is aluminum. Condenser cover 16 is a "stressed member". For purposes of this application, a "stressed member" is a structure that plays a role in providing structure to container 12.

Frame 18 is of any known type suitable for use in refrigeration unit 10. In one embodiment, it is contemplated that frame 18 is aluminum. Frame 18 is a stressed member.

Plurality of structural supports 40 consists of one or more bottom supports 20 and one or more top supports 22. Additionally, plurality of structural supports 40 are made of any material suitable for use in refrigeration unit 10. Each of one or more bottom supports 20 has a first end 26 and a second end 28. Each of one more top supports 22 has a first end 30 and a second end 32. In one embodiment, one or more bottom supports 20 and one or more top supports 22 are made of aluminum. One or more bottom supports 20 and one or more top supports 22 are stressed members. The present disclosure contemplates the use of one or more bottom supports 20. For purposes of clarity, only one bottom support 20 will be described in detail below as each of the one or more bottom supports are assembled in a similar fashion. Similarly, for purposes of clarity, only one top support 22 will be described in detail below as each of the one or more top supports 22 are assembled in a similar fashion.

Back panel 24 is made of any known material sufficient for use in refrigeration unit 10. In one embodiment, back panel 24 is sheet metal.

During assembly, a first end 26 of bottom support 20 is attached to back panel 24 by any method sufficient to do so. In one embodiment, first end 26 is attached to back panel 24 by spot welding or bolting. In a preferred embodiment, one or more bottom supports 20 are bolted to back panel 24. Second end 28 is attached to condenser cover 16 by any manner sufficient to do so. It is contemplated herein that second end 28 may be attached to condenser cover 16 by spot welding or bolting.

First end 30 of top support 22 is attached to back panel 24 by any method sufficient to do so. In one embodiment, first end 30 is attached to back panel 24 by spot welding or bolting. In a preferred embodiment, one or more top supports 22 are bolted to back panel 24. Second end 32 is attached to condenser cover 16 by any manner sufficient to do so. It is contemplated herein that second end 32 may be attached to condenser cover 16 by spot welding or bolting.

Condenser cover 16 is attached to frame 18 by any known means sufficient to do so. In one embodiment, condenser cover 16 is spot welded to frame 18. In another embodiment, condenser cover 16 is attached to frame 18 with bolts or screws.

One coil support member 34 of condenser coil 14 is attached to at least one top support 22 by any known manner such that the condenser coil essentially hangs from the top supports and is an unstressed member providing no structural support to container 12. In one embodiment, coil support member 34 is attached to top support member. In one embodiment, condenser coil 14 is removably secured to each one of top supports 22 using screws or bolts.

Frame 18 is attached to container 12 by any known method sufficient to do so. In one embodiment, frame 18 is attached to container 12 using bolts. In another embodiment, frame 18 is attached to container 12 by spot welding.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof Therefore, it is intended that the present disclosure not be limited to the particular embodiment(s) disclosed as the best mode contemplated, but that the disclosure will include all embodiments falling within the scope of the appended claims.

What is claimed is:

1. A refrigeration unit for a shipping container exposed to end loads and rack loads, comprising:

a frame for securement to the shipping container;

a back panel secured to said frame;

a plurality of structural support brackets secured to said back panel;

a condenser cover secured to said plurality of structural support brackets so that said condenser cover, said plurality of structural support brackets, said frame, and said back panel form a structural member sufficient to support the end loads and rack loads;

a condenser coil having a first end and a second end;

a first coil support member secured to one of said plurality of structural support brackets and secured around said first end;

a second coil support member secured to one of said plurality of structural support brackets and secured around said second end, wherein said first and second coil support members maintain said condenser coil unstressed from the end loads and rack loads.

2. The refrigeration unit of claim 1, wherein said condenser coil is a micro channel condenser coil.

3. The refrigeration unit of claim 1, wherein said plurality of structural support brackets comprise a top support bracket over said condenser coil and a bottom support bracket below said condenser coil.

4. The refrigeration unit of claim 1, wherein said plurality of structural support brackets are aluminum.

5. The refrigeration unit of claim 4, wherein said plurality of structural support brackets have a length of from about seven inches to about twelve inches.

6. The refrigeration unit of claim 4, wherein said plurality of structural support brackets have a width of from about one inch to about three inches.

7. The refrigeration unit of claim 1, wherein:

the back panel is secured to the shipping container via said frame.

8. The refrigeration unit of claim 3, wherein:

said condenser coil hangs from the top support bracket.

* * * * *